US009282393B2

(12) United States Patent
Harper

(10) Patent No.: US 9,282,393 B2
(45) **Date of Patent: *Mar. 8, 2016**

(54) SYSTEM AND METHOD FOR SECURING HEADPHONE TRANSDUCERS

(71) Applicant: Kaddan Entertainment, Inc., New York, NY (US)

(72) Inventor: Patrick Sean Harper, New York, NY (US)

(73) Assignee: KADDAN ENTERTAINMENT, INC., New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/609,891

(22) Filed: Jan. 30, 2015

(65) Prior Publication Data

US 2015/0139471 A1 May 21, 2015

Related U.S. Application Data

(63) Continuation of application No. 14/449,537, filed on Aug. 1, 2014, now Pat. No. 8,976,993, which is a continuation of application No. 13/479,903, filed on May 24, 2012, now Pat. No. 8,798,305, which is a (Continued)

(51) Int. Cl.

| | |
|---|---|
| ***H04R 25/00*** | (2006.01) |
| ***H04R 1/10*** | (2006.01) |
| *H04R 5/033* | (2006.01) |

(52) U.S. Cl.

CPC ..... *H04R 1/105* (2013.01); *H04R 1/10* (2013.01); *H04R 1/1033* (2013.01); *H04R 1/1016* (2013.01); *H04R 5/033* (2013.01)

(58) Field of Classification Search

CPC .... H04R 1/105; H04R 1/1008; H04R 1/1016; H04R 1/1033; H04R 1/1041; H04R 1/1058; H04R 1/1066; H04R 5/0335; H04R 25/652

USPC ..... 381/370, 374, 380, 384

See application file for complete search history.

(56) References Cited

U.S. PATENT DOCUMENTS

| | | | |
|---|---|---|---|
| 2,506,490 | A | 5/1950 | Coley |
| 3,129,477 | A | 4/1964 | Mizuno |

(Continued)

FOREIGN PATENT DOCUMENTS

| | | | |
|---|---|---|---|
| CN | 2497497 | Y | 6/2002 |
| DE | 20006606 | U1 | 10/2000 |

(Continued)

OTHER PUBLICATIONS

Amazon.com: Sennheiser MX 70 Sport Stereo Earbuds with Magnetic Surfaces, www.amazon.com/Sennheiser-MX-70-Magnetic-Surfaces/dp/B000F JEYZ8, Sep. 5, 2013, 5 pages.

(Continued)

*Primary Examiner* — Brian Ensey

(74) *Attorney, Agent, or Firm* — Slater & Matsil, L.L.P.

(57) ABSTRACT

A system for securing headphone transducers is provided. In one aspect of the present invention, the system comprises a first transducer device having a first mechanical housing, which has an outer surface and an inner surface. A first coupling device is affixed to the outer surface of the first mechanical housing of the first transducer device. A second transducer device has a second mechanical housing, which has an outer surface and an inner surface. A second coupling device is affixed to the outer surface of the second mechanical housing of the second transducer device. The first coupling device is coupled to the second coupling device when in close proximity to each other, such that the inner surfaces of the first and second mechanical devices are opposed to each other.

14 Claims, 6 Drawing Sheets

Related U.S. Application Data continuation-in-part of application No. 12/751,027, filed on Mar. 31, 2010, now Pat. No. 8,189,843, which is a continuation of application No. 12/207,041, filed on Sep. 9, 2008, now Pat. No. 7,693,295, which is a continuation of application No. 11/087,628, filed on Mar. 24, 2005, now Pat. No. 7,436,974.

(60) Provisional application No. 60/585,504, filed on Jul. 6, 2004.

(56) References Cited

U.S. PATENT DOCUMENTS

| | | | | |
|---|---|---|---|---|
| 3,875,592 | A | | 4/1975 | Aileo |
| 4,231,137 | A | | 11/1980 | Fujimoto |
| 4,499,593 | A | | 2/1985 | Antle |
| 4,535,870 | A | | 8/1985 | Lindsay |
| 5,036,681 | A | | 8/1991 | Schaerer |
| 5,110,198 | A | | 5/1992 | Travis et al. |
| 5,432,986 | A | | 7/1995 | Sexton |
| 5,572,887 | A | | 11/1996 | Geswelli |
| 5,737,436 | A | | 4/1998 | Boyden |
| 5,806,346 | A | | 9/1998 | Schlinger et al. |
| 5,832,098 | A | | 11/1998 | Chen |
| 5,845,197 | A | | 12/1998 | Hada et al. |
| 5,933,507 | A | | 8/1999 | Woolley et al. |
| 6,154,890 | A | * | 12/2000 | Deopuria et al. ..... 381/371 |
| 6,374,126 | B1 | | 4/2002 | MacDonald, Jr. et al. |
| 6,438,248 | B1 | | 8/2002 | Kamimura et al. |
| 6,473,946 | B1 | | 11/2002 | Cheng |
| 6,481,065 | B2 | | 11/2002 | Cogdill |
| 6,568,805 | B1 | | 5/2003 | Dietz |
| 6,598,272 | B2 | | 7/2003 | Nire |
| 6,640,398 | B2 | | 11/2003 | Hoffman |
| 6,679,828 | B2 | | 1/2004 | Kaufman et al. |
| 6,712,304 | B1 | | 3/2004 | Taylor |
| 6,721,579 | B2 | | 4/2004 | Liu |
| 6,833,507 | B2 | | 12/2004 | Arkin et al. |
| 6,845,158 | B2 | | 1/2005 | Koester et al. |
| 6,981,391 | B2 | | 1/2006 | Suzuki |
| 7,013,492 | B2 | | 3/2006 | Hugh et al. |
| 7,184,565 | B2 | | 2/2007 | Ohta |
| 7,372,974 | B2 | | 5/2008 | Yanagishita et al. |
| 7,436,974 | B2 | | 10/2008 | Harper |
| 7,477,922 | B2 | | 1/2009 | Lewis |
| 7,558,398 | B2 | | 7/2009 | Ito et al. |
| 7,693,295 | B2 | | 4/2010 | Harper |
| 7,995,783 | B2 | | 8/2011 | Ledbetter et al. |
| 8,189,843 | B2 | | 5/2012 | Harper |
| 2002/0076060 | A1 | | 6/2002 | Hall et al. |
| 2002/0131614 | A1 | | 9/2002 | Jakob et al. |
| 2003/0169896 | A1 | | 9/2003 | Kirk, III et al. |
| 2004/0042629 | A1 | | 3/2004 | Mellone et al. |
| 2004/0096079 | A1 | | 5/2004 | Chang et al. |
| 2004/0170294 | A1 | | 9/2004 | Murozaki et al. |
| 2005/0025329 | A1 | | 2/2005 | Lee |
| 2005/0131560 | A1 | | 6/2005 | Quat et al. |
| 2006/0013429 | A1 | | 1/2006 | Ohta |
| 2006/0239491 | A1 | | 10/2006 | Ito |
| 2008/0037817 | A1 | | 2/2008 | Ewert et al. |
| 2008/0159581 | A1 | | 7/2008 | Ito et al. |
| 2010/0284525 | A1 | | 11/2010 | Sandear et al. |
| 2011/0044487 | A1 | | 2/2011 | Nault |

FOREIGN PATENT DOCUMENTS

| | | | | | |
|---|---|---|---|---|---|
| EP | 1341361 | A2 | | 9/2003 | |
| EP | 1509062 | A1 | | 2/2005 | |
| EP | 2339866 | B1 | | 3/2005 | |
| EP | 2339866 | A1 | | 6/2011 | |
| FR | 2808961 | | | 11/2001 | |
| JP | 55-133822 | | | 3/1979 | |
| JP | S62-167486 | | | 10/1987 | |
| JP | 04-14399 | | | 1/1992 | |
| JP | H4-64894 | | | 6/1992 | |
| JP | H6-26390 | | | 4/1994 | |
| JP | 07211140 | | * | 8/1995 | ..... H04R 1/10 |
| JP | 07-211146 | | | 11/1995 | |
| JP | H9-84169 | | | 3/1997 | |
| JP | 09307981 | | * | 11/1997 | ..... H04R 1/10 |
| JP | 2001-237939 | | | 8/2001 | |
| JP | 200456636 | A | | 2/2004 | |
| WO | 0101657 | A1 | | 1/2001 | |
| WO | 03086929 | A1 | | 10/2003 | |
| WO | 03103255 | A1 | | 12/2003 | |
| WO | 2004071056 | A1 | | 8/2004 | |
| WO | 2005086524 | A1 | | 9/2005 | |

OTHER PUBLICATIONS

Sennheiser Electronic GmbH & Co., KG Soundings 1/05, vol. 8, 2005, 36 pages.

Sennheiser Electronic GmbH & Co., KG, Soundings 1/04, vol. 7, 2004, 32 pages.

Sennheiser Electronic GmbH & Co., KG, Soundings, Spring/Summer 2006, vol. 9, 28 pages.

Magnet, from Wikipedia, May 21, 2015, 18 pages.

* cited by examiner

Front View
(with earbud)

Side View
(without earbud)

SYSTEM AND METHOD FOR SECURING HEADPHONE TRANSDUCERS

CROSS-REFERENCE TO RELATED APPLICATIONS

This application is a continuation of U.S. application Ser. No. 14/449,537, filed on Aug. 1, 2014, which is a continuation of U.S. application Ser. No. 13/479,903, filed on May 24, 2012, now U.S. Pat. No. 8,798,305, which is a continuation-in-part of U.S. application Ser. No. 12/751,027, filed Mar. 31, 2010, now U.S. Pat. No. 8,189,843, which is a continuation of U.S. application Ser. No. 12/207,041, filed Sep. 9, 2008, now U.S. Pat. No. 7,693,295, which is a continuation of U.S. application Ser. No. 11/087,628, filed Mar. 24, 2005, now U.S. Pat. No. 7,436,974, which claims the benefit of U.S. Provisional Application No. 60/585,504, filed Jul. 6, 2004. The disclosures of each of the above applications are hereby incorporated by reference in their entireties into the present application.

BACKGROUND OF THE INVENTION

1. Field of the Invention

The present invention relates generally to a system and method for securing headphone transducers and, more particularly, to a system and method for securing headphone transducers through the implementation of coupling means, such as, for example, magnets, hooks, hooks and loops, etc.

2. Description of the Background Art

All United States Patents and patent applications referred to herein are hereby incorporated by reference in their entireties into the present application. In the case of conflict, the present specification, including definitions, will control.

The use of portable audio devices has grown rapidly as a way for people to listen to various audio mediums while on the go. Generally, the devices require an audio transducer/headphone to convert the electrical signals from the portable device to audible sound. Many designs of the "headphones" exist, but increasingly popular are the lightweight ear-bud headphones that are inserted, for example, into the user's ear(s). While these devices provide a convenient solution for listening to audio, one significant disadvantage is, when the ear-buds are inserted into the ears, they block out outside sounds. Thus, the user must remove the ear-buds from his/her ears when wishing to hear any sound other than the audio from the audio device (e.g., engage in a conversation, talk on a cell phone, etc.). When the ear-buds are removed, the user must either hold them (non-hands free) or allow them to dangle from the audio device.

There are several known means for securing objects. For example, U.S. Pat. No. 6,679,828 to Kaufman et al. describes a keychain that can be temporarily secured to a magnetic surface (e.g., the inside of a front door or a refrigerator). The keychain consists of a curved plastic tube with a magnet on one end thereof. The magnetic end, when placed near the desired magnetic surface, attaches itself and supports the weight of the keychain. Since the invention only utilizes one magnet (e.g., affixed to the object that is temporarily secured), it secures to an outside object, rather than to another part of itself.

U.S. Pat. No. 6,640,398 to Hoffman, U.S. Pat. No. 6,481,065 to Cogdill and U.S. Pat. No. 4,231,137 to Fujimoto disclose securing pieces of jewelry using magnets. The magnet replaces a manual clasp. For example, two opposing, attractive magnets are secured to either end of a necklace. When the ends are brought near each other behind the neck, the magnets attract. The attractive force of the magnets is strong enough to secure the necklace around the user's neck. These systems, however, are limited, as the objects that utilize the clasping means generally are disconnected and then reconnected infrequently. Mostly, the connection is made when the user first begins using the object and it is disconnected when the user is completely finished with the object.

U.S. Pat. No. 6,598,272 to Nire relates to a magnetic substitute for a clothing button or belt buckle. Opposing magnets are attached directly to clothing or a belt so that when they are near one another, they attract. As such, the two previously unconnected parts become connected. The magnetic substitute is not used to temporarily store an object that must be unsecured to be used.

U.S. Pat. No. 6,568,805 to Dietz describes securing eyeglasses when not being used. Magnets are attached to the temple bars so that when the glasses are closed, the magnets line up over the center of the glasses. The user can secure the glasses to his/her clothing simply by inserting a small section of the clothing between the two magnets. The magnets attach to clothing, rather than attaching directly to one another to secure the object the user wishes to store.

U.S. Pat. No. 6,473,946 to Cheng concerns a clasp mechanism that uses a bolting mechanism and a locking mechanism through the implementation of magnets. The bolting system uses magnetic attraction to secure a bolt to a bulky or cumbersome lock.

U.S. Pat. No. 5,036,681 to Schaerer discloses securing an earring to a user's ear by means of a magnet; thus, avoiding having to pierce the user's ear. The earring comprises a hinging mechanism wherein one of the ends of the hinge is provided with a magnetic means to confront the ear lobe of a wearer, and the other end is provided with decorative means exteriorly visible when in use. The earring is attached through some additional object (e.g., the earlobe) for long periods of time.

None of the above cited prior art references disclose a system and/or method for securing headphones around a user's neck using coupling means, such as, for example, magnets, hooks, hooks and loops, etc. Thus, there remains a need for a system and method for securing headphones in a simple and convenient manner.

SUMMARY OF THE INVENTION

A primary object of the present invention is to overcome the deficiencies of the prior art systems described above by providing a system for securing headphone transducers. The system comprises a first transducer device having a first mechanical housing, which has an outer surface and an inner surface. A first coupling device is affixed to the outer surface of the first mechanical housing of the first transducer device. A second transducer device has a second mechanical housing, which has an outer surface and an inner surface. A second coupling device is affixed to the outer surface of the second mechanical housing of the second transducer device. The first coupling device is coupled to the second coupling device when in close proximity to each other, such that the inner surfaces of the first and second mechanical devices are opposed to each other.

It is another object of the present invention to provide a system for modifying a preexisting headphone transducer having a wire connected thereto. The system comprises a first backing device having an inner surface and an outer surface. The first backing device comprises a first conductive material at least partially covering the inner surface of the first backing device, a bonding layer at least partially disposed on the first conductive material, and a coupling device affixed to the outer surface of the first backing device. A second backing device has an inner surface and an outer surface, and comprises a second conductive material at least partially covering the inner surface of the second backing device. The first backing device is affixed to one side of the wire of the headphone transducer and the second first backing device is affixed to the other side of the wire of the headphone transducer. The backing devices mate with each other to securely attach to the wire of the headphone transducer.

It is yet another object of the present invention to provide a system comprising a transducer device having a mechanical housing, which has an outer surface and an inner surface. A coupling device is affixed to the outer surface of the mechanical housing of the transducer device. A coupling base has an outer surface and an inner surface. The coupling base comprises a bonding layer at least partially disposed on the inner surface such that the coupling base is permanently or removably affixed to an exterior surface of an object. The coupling device is secured to the coupling base when in close proximity.

In an embodiment, a coupling base, permanently or removably affixed to, or incorporated into, or otherwise associated with an object, can serve as a point of connection for headphones such as those referred to herein, having a clasping system for facilitating storage when the headphones are not in use. Such headphone types can include earbuds, ear clips, or other types suitable for use in accordance with the invention. An embodiment of such a system can include, for example, a transducer having a mechanical housing, a coupling device permanently or removably affixed to the mechanical housing of said transducer, and a coupling base permanently or removably affixed to, or incorporated into an object, whereby the headphone transducer is secured to the coupling base when the coupling device is engaged with the coupling base.

BRIEF DESCRIPTION OF THE DRAWINGS

The accompanying drawings, which are incorporated herein and form part of the specification, illustrate various embodiments of the present invention and, together with the description, further serve to explain the principles of the invention and to enable a person skilled in the pertinent art to make and use the invention. In the drawings, like reference numbers indicate identical or functionally similar elements. A more complete appreciation of the invention and many of the attendant advantages thereof will be readily obtained as the same becomes better understood by reference to the following detailed description when considered in connection with the accompanying drawings, wherein.

DETAILED DESCRIPTION OF THE EXEMPLARY EMBODIMENTS

Figure 1:
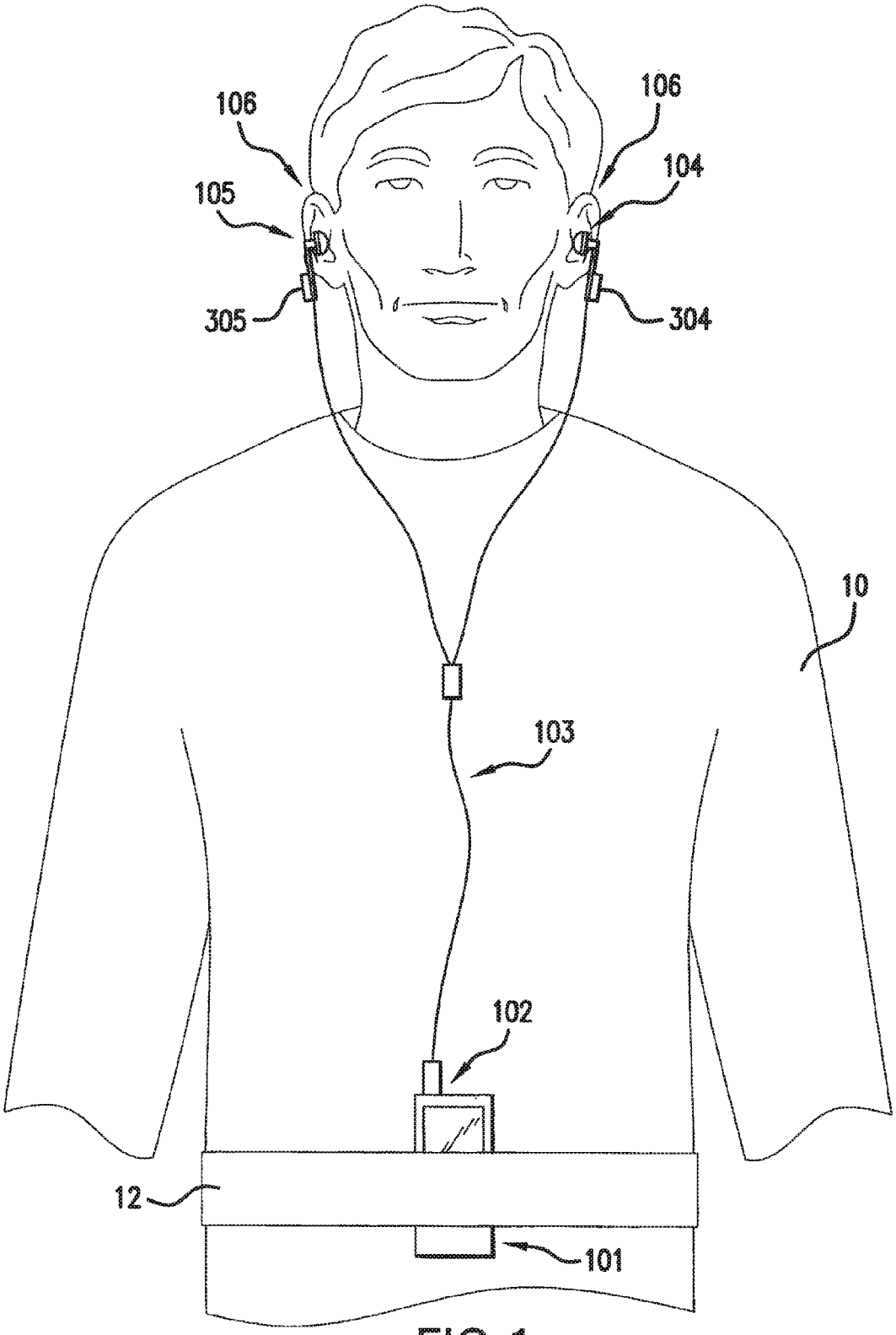
FIG. 1 is a drawing showing a user wearing headphone transducers utilizing a system for securing the headphone transducers of the exemplary embodiment of the present invention.

FIG. 1 is an illustration showing a user wearing headphone transducers utilizing a system for securing headphone transducers of the exemplary embodiment of the present invention. Referring to FIG. 1, a user 10 operates a portable audio device 101. Preferably, the audio device 101 is placed in a user's pocket, or attached to a user's armband or belt 12. The audio device 101 comprises a jack 102 adapted to accommodate a cable 103. The cable 103 is connected at one end to a left ear-bud transducer 105 and a right ear-bud transducer 104. The left ear-bud transducer 105 and the right ear-bud transducer 104 are inserted directly into the ears 106 of the user 10, such that audio can be heard when the other end of the cable 103 is plugged into the jack 102 of the audio device 101.

Figure 2:
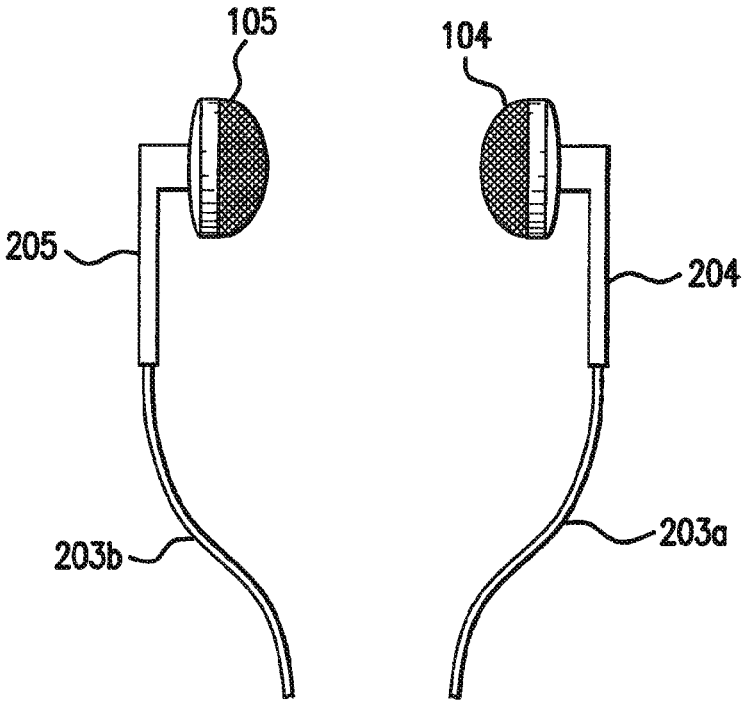
FIG. 2 is a perspective view of the headphone transducers illustrated in FIG. 1 without a coupling device.

As illustrated in FIG. 2, wires 203*b*, 203*a* are connected to a left mechanical housing 205 and a right mechanical housing 204, respectively. The left mechanical housing 205 and the right mechanical housing 204 can encompass, enclose, house, include, comprise, be connected to, or the like, the left ear-bud transducer 105 and the right ear-bud transducer 104, respectively. Alternatively, the left ear-bud transducer 105 and the right ear-bud transducer 104 can encompass, enclose, house, include, comprise, be connected to, or the like, the left mechanical housing 205 and the right mechanical housing 204, respectively. The wires 203*b*, 203*a* forming part of the cable 103 typically hangs freely in front of the user's head when connected to the audio device 101.

Figure 3:
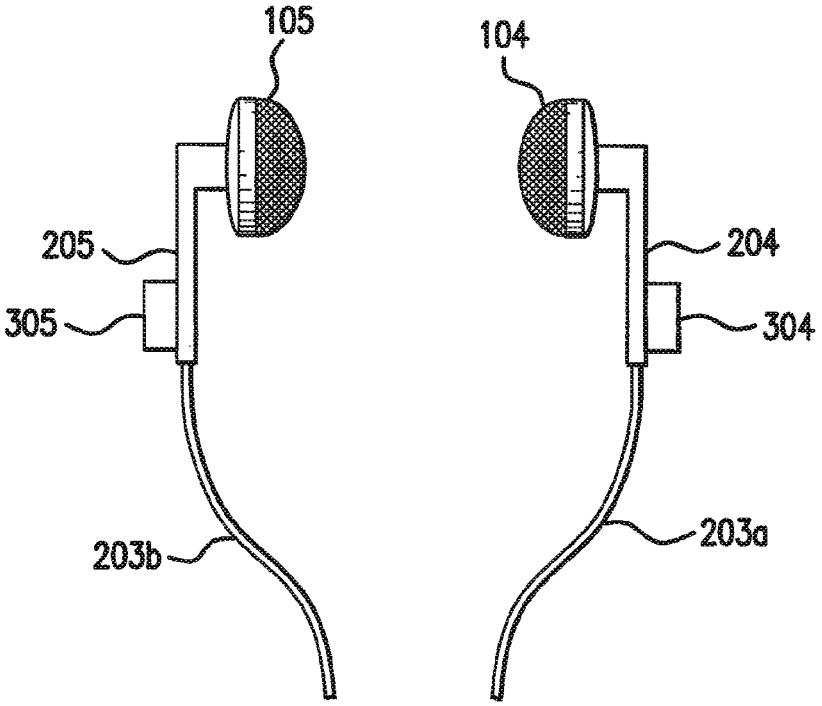
FIG. 3 is a perspective view of the headphone transducers illustrated in FIG. 1 with a coupling device.

FIG. 3 is a perspective view of the headphone transducers illustrated in FIG. 1. In the exemplary embodiment, a magnet 305 with a positive polarity is attached to the outside of the left mechanical housing 205 of the left ear-bud transducer 105. The magnet 305 is placed at a sufficient distance from the left ear-bud transducer 105 so as not to cause magnetic interference sonic performance of the left ear-bud transducer 105. Correspondingly, a magnet 304 with a negative polarity is attached to the outside of the right mechanical housing 204 of the right ear-bud transducer 104. The magnet 304 is also placed at a sufficient distance from the right ear-bud transducer 104 so as not to cause magnetic interference sonic performance of the right ear-bud transducer 104. It will be appreciated by those skilled in the art that the magnets 305, 304 can have either a positive or negative polarity, but not the same polarity. In other words, the polarities of the magnets must be opposite and attractive.

The magnets 305, 304 are attached to the mechanical housings 205, 204 using any well known and suitable bonding means, such as, for example, glue, adhesives, molding, etc. Accordingly, the system for securing headphone transducers of the present invention can be added to preexisting headphones, as discussed in detail below.

Figure 4:
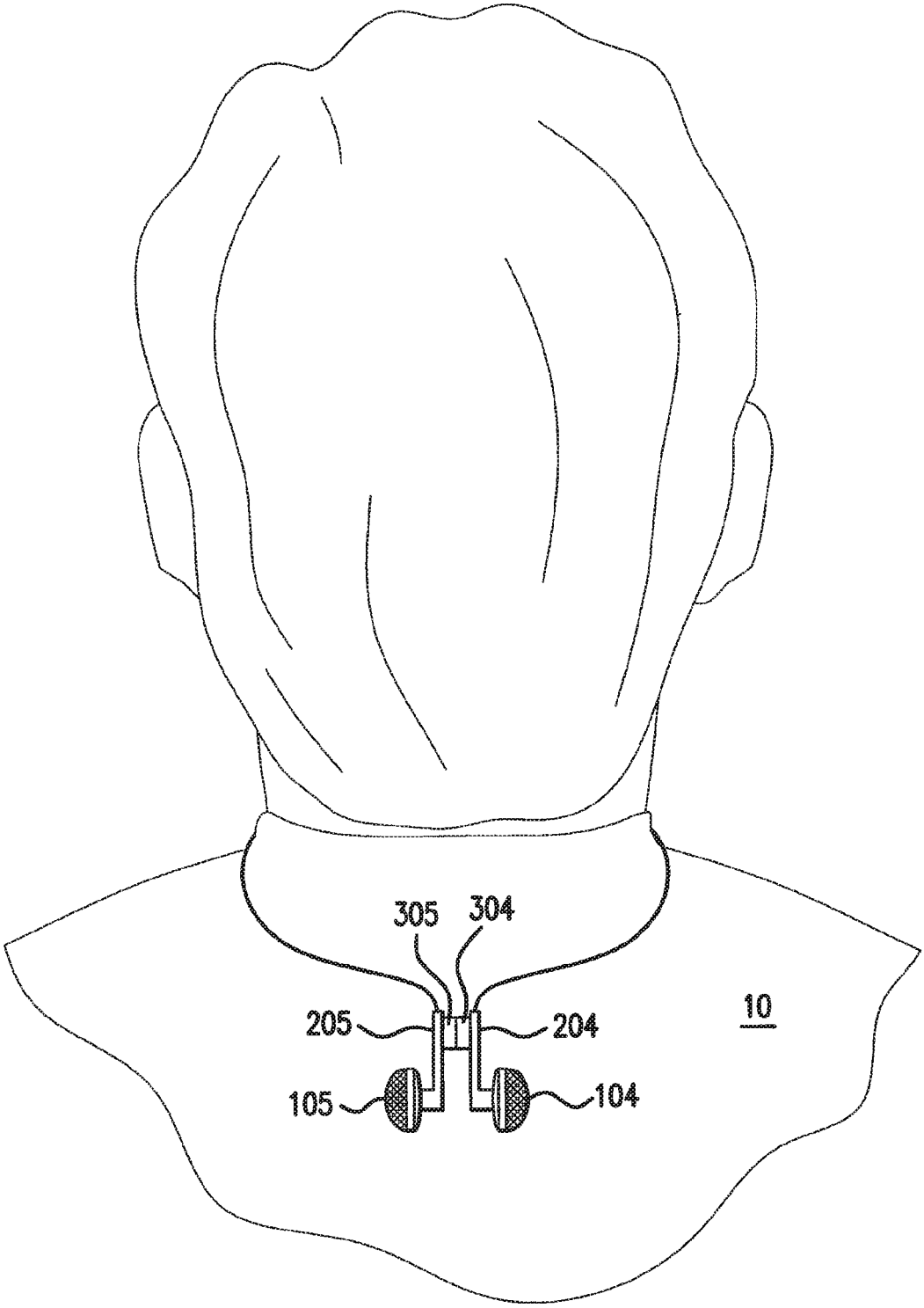
FIG. 4 is a diagram showing the ear-bud headphones in a rest state.

The magnets 305, 304 have sufficient charge so as to form a tight bond between the left ear-bud transducer 105 and the right ear-bud transducer 104. Further, the magnets 305, 304 provide a secure connection between the ear-bud transducers 105, 104 that is capable of supporting the combined weight of the ear-bud transducers 105, 104 when they are attracted. For example, as illustrated in FIG. 4, when the user 10 desires a temporary break from listening to his/her audio device 101 through the ear-bud transducers 105, 104, he/she removes the ear-bud transducers 105, 104 from his/her ears 106. The user 10 then moves or pulls the ear-bud transducers 105, 104 together, such that the magnets 305, 304 attract the ear-bud transducers 105, 104 and hold them securely together.

It will be appreciated by those skilled in the art that the bond between the magnets 305, 304 is not permanent, thereby allowing the user 10 to pull apart or separate the ear-bud transducers 105, 104, and place them back into the ears 106 of the user 10 without difficulty.

Figure 5A:
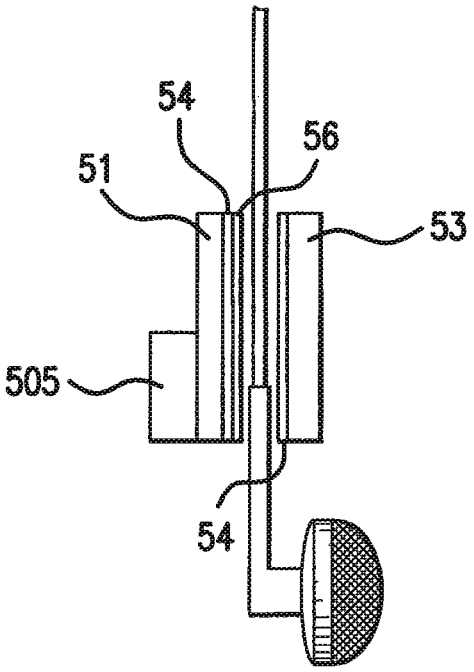
FIGS. 5A through 5C illustrate the system for securing headphone transducers of the exemplary embodiment of the present invention added to preexisting ear-bud headphones.
Figure 5B:
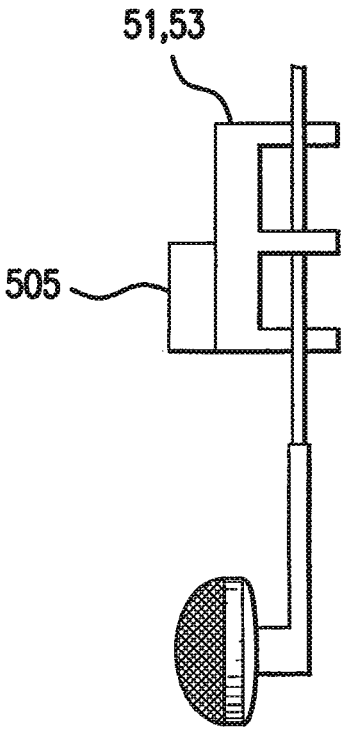
Figure 5C:
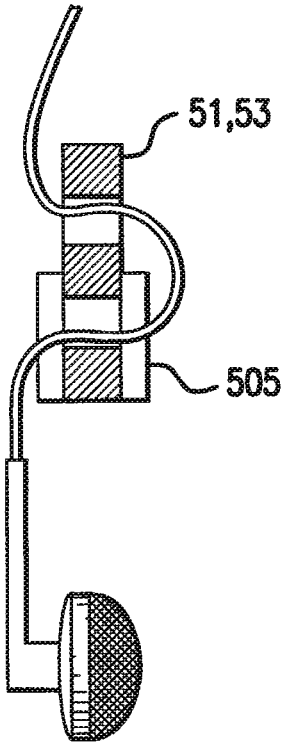

FIGS. 5A through 5C illustrate the system for securing headphone transducers of the exemplary embodiment of the present invention added to preexisting ear-bud headphones. FIG. 5A is a front elevational view of the system for securing headphone transducers of the present invention added to preexisting ear-bud headphones; FIG. 5B is a side elevational view of the system for securing headphone transducers of the present invention added to preexisting ear-bud headphones; and FIG. 5C is a top elevational view of the system for securing headphone transducers of the present invention added to preexisting ear-bud headphones. For the sake of convenience, only one ear-bud transducer incorporating the securing system of the present invention will be described in detail below. However, it will be understood by the skilled person that both ear-bud transducers of preexisting ear-bud headphones can be modified to include the system for securing headphone transducers of the present invention. Referring to FIGS. 5A through 5C, a first backing 51 has outer and inner surfaces, and a second backing 53 has outer and inner surfaces. The first backing 51 and the second backing 53 can be of any suitable material, such as, for example, plastic, etc. The first backing 51 includes conductive material 54, such as, for example, a strip of foam, plastic, etc., and a bonding layer 56, such as, for example, an adhesive layer, etc., on its inner surface. Further, the first backing 51 includes a charged magnet 505 securely affixed to its outer surface.

The second backing 53 includes conductive material 54, such as, for example, a strip of foam, etc. on its inner surface. It will be appreciated by those skilled in the art that the second backing 53 may also include a bonding layer on its inner surface. However, the second backing 53 does not necessarily have a bonding layer, as the bonding layer on the first backing may be sufficient to bind both backings when mated. The opposing backings (to be added to the other ear-bud transducer) should have a structure that complement the backings of the above described securing system.

When the backings 51, 53 are placed on either side of the headphone wire, the opposing conductive material 54 indents to form a tight grip on the headphone wire while simultaneously securing each backing 51, 53 to one another. Once the backings 51, 53 are secured to one another and the wire, the preexisting ear-bud headphones function in the same manner described above with respect to the system for securing headphone transducers of the exemplary embodiment of the present invention.

Figure 6A:
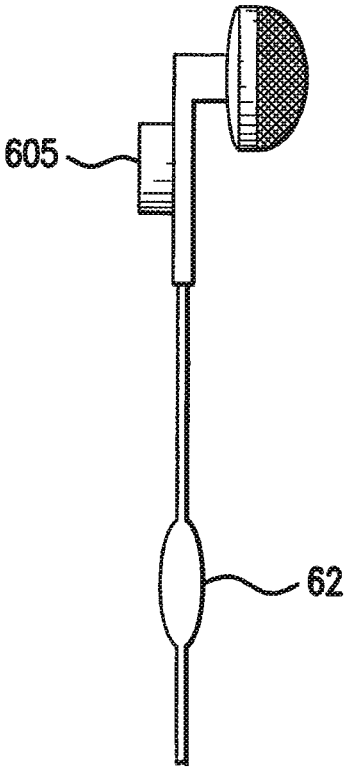
FIGS. 6A through 6C illustrate the system for securing headphone transducers according to another exemplary embodiment of the present invention.
Figure 6B:
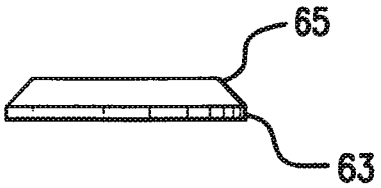
Figure 6C:
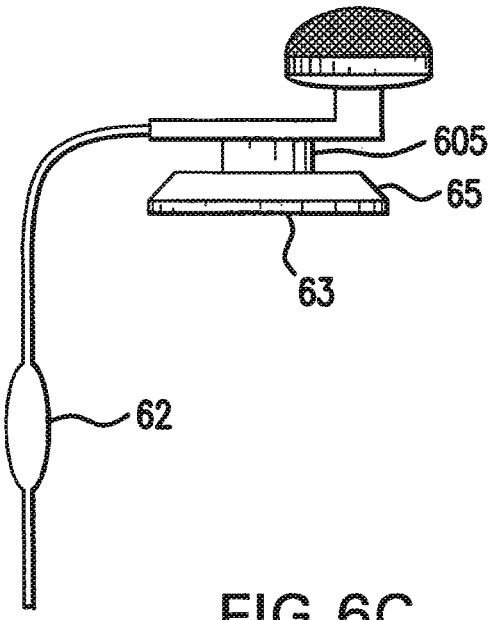

FIGS. 6A through 6C are illustrations of the system for securing headphone transducers according to another exemplary embodiment of the present invention. FIG. 6A is an illustration of an ear-bud according to another exemplary embodiment of the present invention; FIG. 6B is a diagram of a magnetic base according to another exemplary embodiment of the present invention; and FIG. 6C is a diagram of a securing system according to another exemplary embodiment of the present invention. As illustrated in FIGS. 6A through 6C, a single ear-bud has a magnet 605 securely affixed to the outer surface of a mechanical housing. The single ear-bud can be connected to a microphone 62, such that it is adapted to be used with a cell phone, walkie-talkie, or the like. In the exemplary embodiment, the magnet 605 is securely affixed to the mechanical housing of the single ear-bud using any well known and suitable bonding means, such as, for example, glue, adhesives, molding, etc. In alternative embodiments, the magnet 605 can be added to a preexisting ear-bud as described in detail above.

Referring to FIG. 6B, a magnetic base 65 having an adhesive layer 63 on its inner surface can be permanently or removably affixed to any surface including, for example, a dashboard of a vehicle, a desk, wall, computer monitor, telephone, portable device, etc. Once the magnetic base 65 is secured, the user 10 may, when wishing to temporarily stop using the ear-bud, remove the ear-bud from his/her ear 106 and attach it to the magnetic base 65 via magnet 605 (FIG. 6C). By bringing the magnet 605 within close proximity to the magnetic base 65, the two magnetic components 605, 65 attract with enough force to keep the single ear-bud (including microphone 62) securely in place. When the user 10 wishes to resume using the single ear-bud, he/she simply gives a light tug on the ear-bud and the magnets 605, 65 become disengaged, thereby allowing the user 10 to re-insert the ear-bud back into his/her ear 106 without difficulty.

While the aforementioned system for securing headphone transducers of the present invention has been described above using a magnet(s) to temporarily secure the headphones, other temporary clasping systems can be realized. For example, a Velcro® attachment system (e.g., hooks and loops) can be implemented in the present invention. In this embodiment, one of each of the connecting sides of the Velcro® is attached using any well known and suitable bonding means, such as, for example, glue, adhesives, molding, etc., to each individual ear-bud and/or base. When the ear-buds are mated, the hooks on one ear-bud (or base) connects with the loops on the other ear-bud (or base), thereby temporarily securing the ear-buds (or the ear-bud(s) to the base).

A hook system can also be implemented in the present invention. In this embodiment, a small hook is placed on the outside of one of the individual ear-buds. The hook is attached to the ear-bud using any well known and suitable bonding means, such as, for example, glue, adhesives, molding, screwing, etc. When the hook is in place, the user attaches the hook to the wire connected to the opposite ear-bud, thereby temporarily securing the ear-buds. In another embodiment, hooks can be placed on the outside of each of the individual ear-buds and mated together to temporarily secure the ear-buds. In yet another embodiment, a hook can be placed on one of the ear-buds and on a base.

Figure 7B:
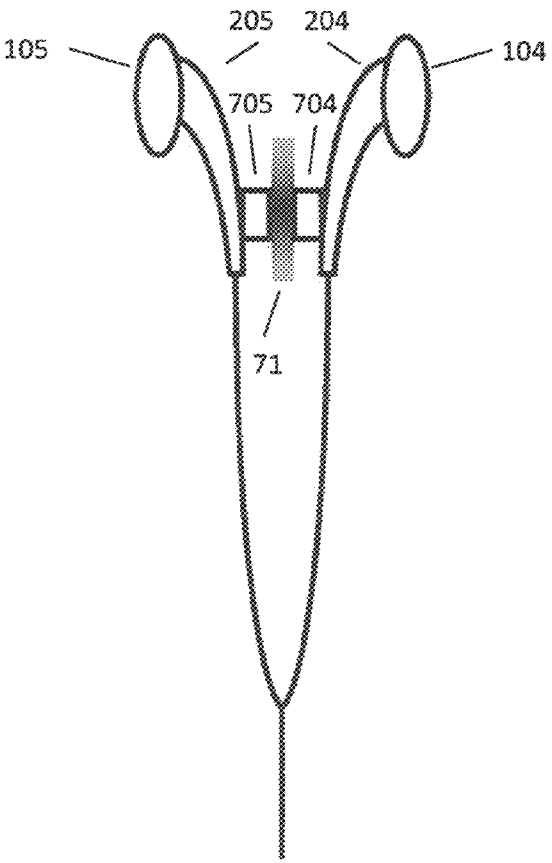
FIGS. 7A and 7B illustrate a system for securing headphone transducers in accordance with another exemplary embodiment of the invention.
Figure 7A:
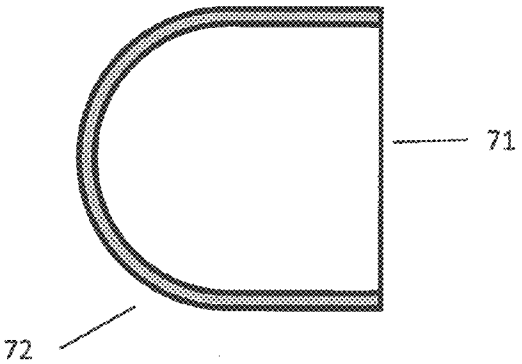

Referring to FIG. 7A, in an embodiment of the present invention, a coupling base 71 is shown. In the illustrated embodiment, the coupling base includes a raised edge 72 around at least part of its perimeter. Such a feature can be included on one or more surfaces of the coupling base and can be useful in preventing the coupling device or devices (and thus, the headphone transducers) from sliding, or otherwise becoming dislodged from a preferred position on the base. Although shown in isolation in the figure, a coupling base is preferably attached or affixed to, incorporated into, or otherwise permanently or removably associated with an object, such as those described herein.

As illustrated in FIG. 7B, headphones also can be temporarily secured to one or multiple sides of such a coupling base 71 via the headphones' coupling device or devices 704, 705 or to one another around or through the coupling base. In the illustrated embodiment, transducers 104,105 have mechanical housings 204, 205 with which the coupling devices 704, 705 are associated. As noted herein, the coupling devices can be or comprise any suitable material that permits the system to function as intended. When one or both coupling devices are magnets, for example, they can be temporarily secured directly to one or more sides of the coupling base, which could include either a ferrous metal (one which is attracted to a magnet), or another material to which the magnet will attract, or a magnet itself.

When the coupling devices are not magnets (e.g. hooks and loops, snaps, snap buttons, other types of interlocking or complementary parts, etc.), the coupling base may comprise the coupling device itself (i.e. a hook or a loop) to which either one or both of the headphone coupling devices may be affixed or otherwise associated with, as described. Alternatively, when one or both coupling devices are magnets, the headphones can be temporarily secured to or engaged with one another via the coupling devices, with the coupling base in between, effectively coupling or securing all three of the base and each of the two coupling devices, as depicted in FIG. 7B. In an alternate embodiment, the coupling base may also be a loop or comprise a loop or similar configuration, through which the headphones may be secured or engaged via their coupling devices, allowing the headphones to hang from the coupling base, for example.

In the illustrated embodiment, when one or both coupling devices are magnets, the coupling base could be made of or comprise metal (either ferrous or non-ferrous), fabric, plastic, rubber or any other suitable material. The object to which this coupling base is either permanently or removably affixed, attached to, incorporated into or otherwise associated with could include clothing, a hat, a bag, an electronic device, an electronic device case, a personal accessory, eyeglasses, sunglasses, jewelry, a zipper handle/pull, athletic equipment, other storage device, such as a rack, shelf or locker, or any other object described elsewhere herein or otherwise suitable for use in accordance with the invention. It should be noted that the coupling base, coupling devices and other features of the systems described herein are not limited to the shapes, configurations and materials as specifically detailed in the illustrated and otherwise described exemplary embodiments.

As also described herein, the clasping system can include coupling devices permanently or removably affixed to, attached to, incorporated into, or otherwise permanently or removably associated with headphone transducers. When a coupling device is incorporated into a headphone transducer, for example, the coupling device can form part of the transducer mechanical housing. As shown in, for example, FIGS. 4 and 7B, the coupling devices can also, for example, be engaged or coupled in such a manner as to result in a specific orientation.

As noted above, still other variations of clasping systems, coupling devices, and coupling bases can be used in accordance with the invention. These include those having snaps and other interlocking or otherwise complementary surfaces or features that can engage or mate temporarily to permit the invention to be used as described herein.

The system for securing headphone transducers and method of the present invention and variations thereof can also be implemented with ear-clip headphones. The ear-clip headphone is similar to the ear-bud headphones, as the only connection between the left and right transducers is the headphone wire (unlike with traditional headphones whereby a connecting device connects the two by going over the top of the head). In this embodiment, a clip, usually made of plastic, is attached to each transducer allowing the user to clip it in place around the outer ear; thus, securing the transducer directly over the outer ear.

The foregoing has described the principles, embodiments, and modes of operation of the present invention. However, the invention should not be construed as being limited to the particular embodiments described above, as they should be regarded as being illustrative and not as restrictive. It should be appreciated that other variations may be made in those embodiments by those skilled in the art without departing from the scope of the present invention.

While preferred embodiments of the present invention have been described above, it should be understood that such have been presented by way of example only, and not limitation. Thus, the breadth and scope of the present invention should not be limited by the above described exemplary embodiments.

Obviously, numerous modifications and variations of the present invention are possible in light of the above teachings. It is therefore to be understood that the invention may be practiced otherwise than as specifically described herein.

What is claimed:

1. A system for modifying a preexisting headphone transducer housing, the system comprising:

a coupling device configured to be permanently or removeably attached to a mechanical housing of the headphone transducer;

wherein the coupling device comprises a magnet, and the coupling device, when attached to the mechanical housing of the headphone transducer, is configured to secure the headphone transducer.

2. The system of claim 1, wherein the coupling device is a first coupling device, the headphone transducer is a first headphone transducer, and the system further comprises:

a second coupling device configured to be permanently or removeably attached to a mechanical housing of a second headphone transducer;

wherein the second coupling device is configured to releasably engage with the first coupling device, and the first and second headphone transducers are secured to each other when the first and second coupling devices are engaged.

3. The system of claim 2, wherein said magnet is a first magnet, and the second coupling device comprises a second magnet, and said first magnet is attracted to said second magnet.

4. The system of claim 2, wherein said first coupling device is configured to couple to said second coupling device in a specific orientation.

5. The system of claim 1, wherein said coupling device is configured to attach to the headphone transducer housing by means of friction.

6. The system of claim 1, wherein said coupling device is configured to attach to the headphone transducer housing by means of an adhesive.

7. A system for modifying a preexisting headphone transducer housing, the system comprising:

a coupling device configured to be permanently or removeably attached to a mechanical housing of the headphone transducer; and a coupling base configured to be permanently or removeably attached to an object;

wherein the coupling device, when attached to the mechanical housing of the headphone transducer, is configured to secure the headphone transducer;

wherein the coupling device is configured to releasably engage with the coupling base, and the headphone transducer is secured to the object when the coupling device and coupling base are engaged.

8. A system for modifying a preexisting headphone transducer wire, the system comprising:

a coupling device configured to be permanently attached to a wire of the headphone transducer;

wherein the coupling device comprises a magnet, and the coupling device, when attached to the wire of the headphone transducer, is configured to secure the headphone transducer wire.

9. The system of claim 8, wherein the coupling device is a first coupling device, the headphone transducer is a first headphone transducer, and the system further comprises:

a second coupling device configured to be permanently attached to a wire of a second headphone transducer;

wherein the second coupling device is configured to releasably engage with the first coupling device to secure at least a portion of the wires of the first and second headphone transducers to each other, and engagement of the first and second coupling devices limits movement of the first and second headphone transducers with respect to each other.

10. The system of claim 9, wherein said magnet is a first magnet, the second coupling device comprises a second magnet, and said first magnet is attracted to said second magnet.

11. The system of claim 9, wherein said first coupling device is configured to couple to said second coupling device in a specific orientation.

12. The system of claim 8, wherein said coupling device is configured to attach to the headphone transducer wire by means of friction.

13. A system for modifying a preexisting headphone transducer wire, the system comprising:

a coupling device configured to be permanently attached to a wire of the headphone transducer;

wherein the coupling device, when attached to the wire of the headphone transducer, is configured to secure the headphone transducer wire;

wherein said coupling device is configured to attach to the headphone transducer wire by means of an adhesive.

14. A system for modifying a preexisting headphone transducer wire, the system comprising:

a coupling device configured to be permanently attached to a wire of the headphone transducer; and a coupling base configured to be permanently or removeably attached to an object;

wherein the coupling device, when attached to the wire of the headphone transducer, is configured to secure the headphone transducer wire;

wherein the coupling device is configured to releasably engage with the coupling base, the headphone transducer wire is secured to the object when the coupling device and coupling base are engaged, and engagement of the coupling device and the coupling base limits movement of the headphone transducer with respect to the object.

* * * * *